US005956819A

United States Patent [19]

Terasaki et al.

[11] Patent Number: 5,956,819

[45] Date of Patent: Sep. 28, 1999

[54] SLIDER FOR CONCEALED SLIDE FASTENER

[75] Inventors: Ichiro Terasaki; Hisashi Yoneshima; Koji Yamagishi, all of Toyama, Japan

[73] Assignee: YKK Corporation, Tokyo, Japan

[21] Appl. No.: 09/032,042

[22] Filed: Feb. 27, 1998

[30] Foreign Application Priority Data

Feb. 28, 1997 [JP] Japan ..... 9-045056

[51] Int. Cl.[6] ..... A44B 19/00

[52] U.S. Cl. ..... 24/432; 24/419; 24/424

[58] Field of Search ..... 24/432, 421, 424, 24/419, 429

[56] References Cited

U.S. PATENT DOCUMENTS

| | | | |
|---|---|---|---|
| 3,284,864 | 11/1966 | Howell . | |
| 3,516,127 | 6/1970 | Howell . | |
| 3,729,781 | 5/1973 | Fukuroi | 24/424 |
| 4,829,638 | 5/1989 | Ishii | 24/421 |
| 4,982,479 | 1/1991 | Oda | 24/424 |
| 5,093,966 | 3/1992 | Yuki et al. | 24/419 |

FOREIGN PATENT DOCUMENTS

| | | | |
|---|---|---|---|
| 0576771 | 6/1959 | Canada | 24/424 |
| 0 338 545 | 10/1989 | European Pat. Off. . | |
| 2140165 | 1/1973 | France . | |
| 304015 | 12/1954 | Switzerland . | |

*Primary Examiner*—Victor N. Sakran
*Attorney, Agent, or Firm*—Hill & Simpson

[57] ABSTRACT

A concealed slide fastener slider comprises: a slider body having a guide post on which an attachment lug stands; a resilient locking lever attached at one end to the attachment lug and having at the other end a locking pawl retractably inserted into an element guide channel of the slider body; a clamp having an aperture and a central bent portion bent in an inverted L shape so that the clamp can fall flat to a rear side of the slider body; and a pull tab loosely threaded through the aperture. When a cloth is jammed between the slider body and the clamp, only a front part of the clamp assumes an upright posture but a rear part of the clamp to which the pull tab is attached assumes a horizontal posture, thus causing the pull tab to rest on the cloth.

7 Claims, 11 Drawing Sheets

SLIDER FOR CONCEALED SLIDE FASTENER

BACKGROUND OF THE INVENTION

1. Field of the Invention

This invention relates to an auto-lock slider or a free-type slider, for a concealed slide fastener, in which the pull-tab-supporting point of a clamp is low in level so as to touch a cloth during opening the fastener chain or stopping the slider, while the pull-tab-supporting point of the clamp is high in level during closing the fastener chain.

2. Description of the Related Art

In a conventional free-type slider to be used in a concealed slide fastener, a planar triangle-type clamp is pivotally connected at one end to an attachment lug standing on an upper surface of a guide post of the slider body an other end to a pull tab.

Japanese Utility Model Laid-Open Publication No. Hei 7-16608 discloses an auto-lock slider for a concealed slide fastener as shown in FIG. 10 of the accompanying drawings. In this auto-lock slider, a planar triangle-type clamp 3' is loosely threaded at one end on a locking lever 4', which is pivotally mounted on an attachment lug 6' standing on a guide post and is urged by a U-shaped leaf spring 28' in such a manner that a locking pawl 16' of the locking lever 4' normally projects into an element guide channel 8' in the slider body 1', and at the other end or base end to a pull tab 2'.

Further, Japanese Utility Model Publication No. Hei 7-21122 discloses a slider for an ordinary type slide fastener as shown in FIG. 11. In this slider, a clamp 3" for connecting a pull tab to a slider body has a planar circular aperture 19" and has at one end a pivot portion 40, at the outside of which a pull-tab-attaching hook 22" bulges integrally. Further, a U-shaped resilient plate 28", which covers the pivot portion 40, has at one end an outward punched-out tongue 41 to be engaged in an upper recess in the upper inner surface of the hook 22" and at the other end an outwardly bent portion 42 resiliently touching a lower recess 26" of an end portion of the hook 22". The aperture 19" of the clamp 3" is threaded on an attachment lug standing on the slider body.

In either of the above-mentioned convention free-type slider or the auto-lock slider of FIG. 10, since the clamp will stand up to project from a cloth such as a garment due to the pressure of an edge portion of the cloth when the slider is stopped, a pull-tab-attaching point of the clamp will be raised high so that the pull tab can swing freely during using, which makes the slider unsightly. In the conventional auto-lock slider, since the clamp 3' is not directed in one way and will fall in opposite sideways freely if the pull tab 2' is gripped in a certain way when the clamp 3' pulls up the locking lever 4' during closing the fastener chain, frictional resistance on the cloth is inevitably large so that smooth movement of the slider cannot be realized particularly if the cloth is thick.

In the clamp 3" of FIG. 11, which is to be used in the ordinary type slide fastener, the aperture 19" of the clamp 3" has a large circular shape so that frictional resistance on the cloth is so large to damage the cloth during closing and opening the fastener chain. Therefore this clamp 3" cannot be used for an concealed slide fastener. Further, since the resilient plate 28" extending astride of the pivot portion 40 of the clamp 3" is not fixed to the clamp 3", it tends to jog within the clamp 3" so that smooth pulling of the pull tab is difficult to achieve.

SUMMARY OF THE INVENTION

A first object of this invention is to provide a free-type slider or an auto-lock slider, for a concealed slide fastener, in which, if a cloth such as of a garment is jammed between a slider body and a clamp when a slide fastener is used, a pull tab rests on the cloth by the pressing action of the clamp even when the clamp stands up due to the jamming, thus keeping the pull tab in position on the cloth so that the fastener chain can be closed and opened smoothly and reliably. Further, as the pull tab is stabilized in position all times, the slider is neat in appearance.

A second object of the invention is to provide an auto-lock slider, for a concealed slide fastener, which is excellent in operability and neat in appearance.

A third object of the invention is to provide an auto-lock slider, for a concealed slide fastener, in which, the clamp is directed in substantially only one way regardless of the direction of pulling of the pull tab and is such a type that the pull tab can be exchanged with another. Further, since a resilient plate is firmly mounted on the clamp, this slider is good in durability.

A fourth object of the invention is to provide an auto-lock slider, for a concealed slide fastener, in which a locking lever can be raised simply and reliably by the lever action of the clamp with the attachment lug serving as a fulcrum when closing the fastener chain, thus facilitating sliding the slider with the locking lever kept in raised position.

A fifth object of the invention is to provide an auto-lock slider, for a concealed slide fastener, in which the lever's principle can be applied using a clamp which is simple in structure and easy to manufacture, thus reducing the cost of production.

A sixth object of the invention is to provide an auto-lock slider, for a concealed slide fastener, in which a clamp of any kind of form is directed reliably in one way as it is pivotally moved along the locking lever, thus causing the slider to slide smoothly.

A seventh object of the invention is to provide a free-type slider, for a concealed slide fastener, in which a clamp is directed in substantially only one way regardless of the direction of pulling of the pull tab and is such a type that the pull tab can be exchanged with another. Further, since a resilient plate is firmly mounted on the clamp, this slider is good in durability.

A slider for a concealed slide fastener, according to a first aspect of the invention, comprises: a slider body having a guide post at its front end and a pair of side guide flanges bent from its opposite side edges so as to define therebetween an element guide channel; an attachment lug standing on the guidepost; a clamp directly or indirectly attached to the attachment lug and having an aperture and a base end, the clamp having a central bent portion bent into a generally inverted L shape so that the clamp can fall to a rear side of the slider body; and a pull tab pivotally attached to the base end of the clamp.

According to a second aspect of the invention, the slider further comprises an auto-lock mechanism including a resilient locking lever loosely inserted through the aperture of the clamp, the locking lever being pivotally attached at one end to the attachment lug and having at the other end a locking pawl.

According to a third aspect of the invention, the clamp has a pull-tab-attachment hook projecting from the base end, astride of which a U-shaped resilient plate having a turnover portion extends so as to cover an opening of the hook in such a manner that opposite ends of the resilient plate resiliently touch inner surfaces of the hook, the clamp having in its inner surfaces a pair of bulge portions by which the turnover portion of the resilient plate is kept in position, the aperture having a triangular shape.

According to a fourth aspect of the invention, the attachment lug has a pair of inner corners with which the bent portion of the clamp is touchable so that the clamp can stand upright on the front side of the slider body.

According to a fifth aspect of the invention, the clamp has the aperture in its center and has a varying width progressively increasing from its front end toward the base end to which the pull tab is pivotally attached, the bent portion of the clamp having a width within that of the attachment lug.

According to a sixth aspect of the invention, the aperture of the clamp extending from the bent portion to the front end of the clamp has a width corresponding to the width of the locking lever.

According to a seventh aspect of the invention, the slider is a free type in which the clamp has a pull-tab-attachment hook projecting from the base end, astride of which a U-shaped resilient plate having a turnover portion extends so as to cover an opening of the hook in such a manner that opposite ends of the resilient plate 18 resiliently touch inner surfaces of the hook, the clamp having in its inner surfaces a pair of bulge portions by which the turnover portion of the resilient plate is kept in position, the aperture having a triangular shape, the clamp being directly attached to the attachment lug.

DETAILED DESCRIPTION OF THE PREFERRED EMBODIMENTS

Various preferred embodiments of a slider for a concealed slide fastener according to this invention will now be described in detail with reference to the accompanying drawings.

Figure 1:
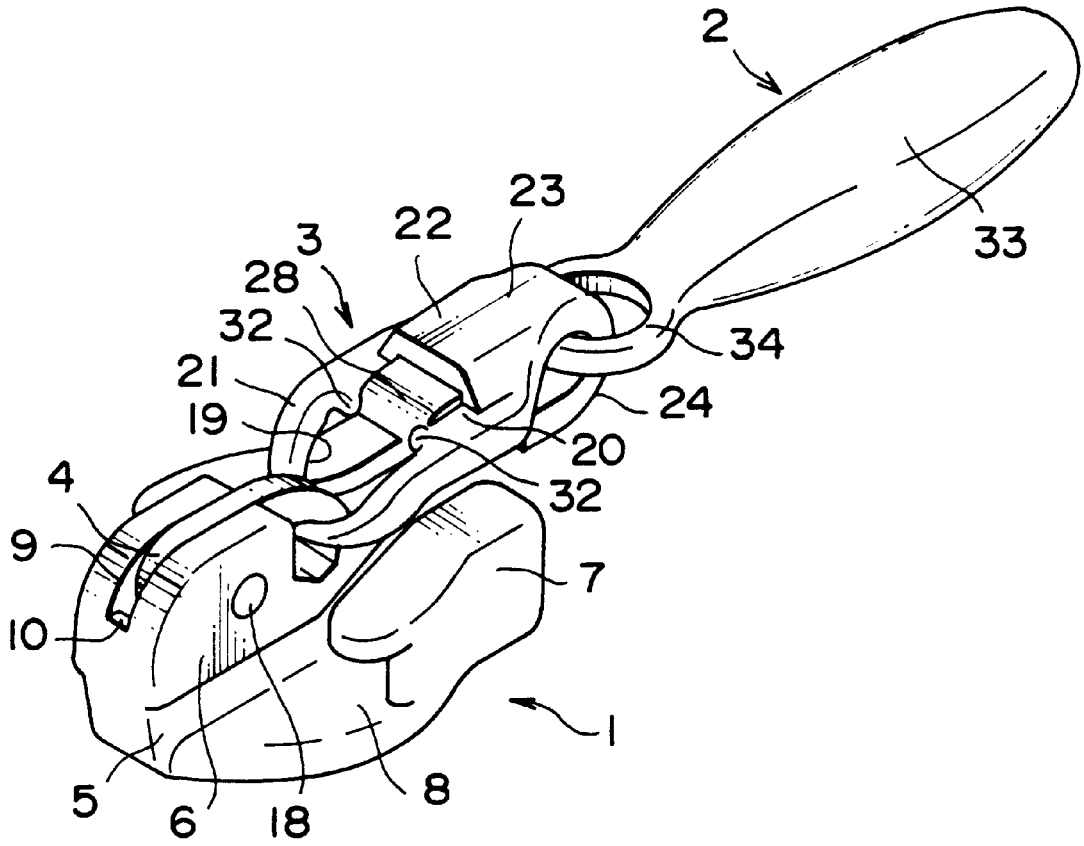
FIG. 1 is a perspective view of an auto-lock slider, for a concealed slide fastener, according to a first embodiment of this invention.

FIG. 1 shows an auto-lock slider, for a concealed slide fastener, according to a first embodiment of the invention. This auto-lock slider comprises a slider body 1 having a guide post 5 at its front end, an attachment lug 6 standing on the top of the guide post 5 and at opposite sides of a rear end of the attachment lug 6 a pair of side flanges 7 bent from opposite side edges of the slider body 1 so as to define therebetween an element guide channel 8, a resilient locking lever 4 pivotally mounted in a longitudinal groove 9 of the attachment lug 6 and having a locking pawl 16 projecting from a free end of the lever 4 and retractably inserted in the element guide channel 8, a clamp 3 loosely threaded on the locking lever 4, and a pull tab 2 connected to the clamp 3.

Figure 2:
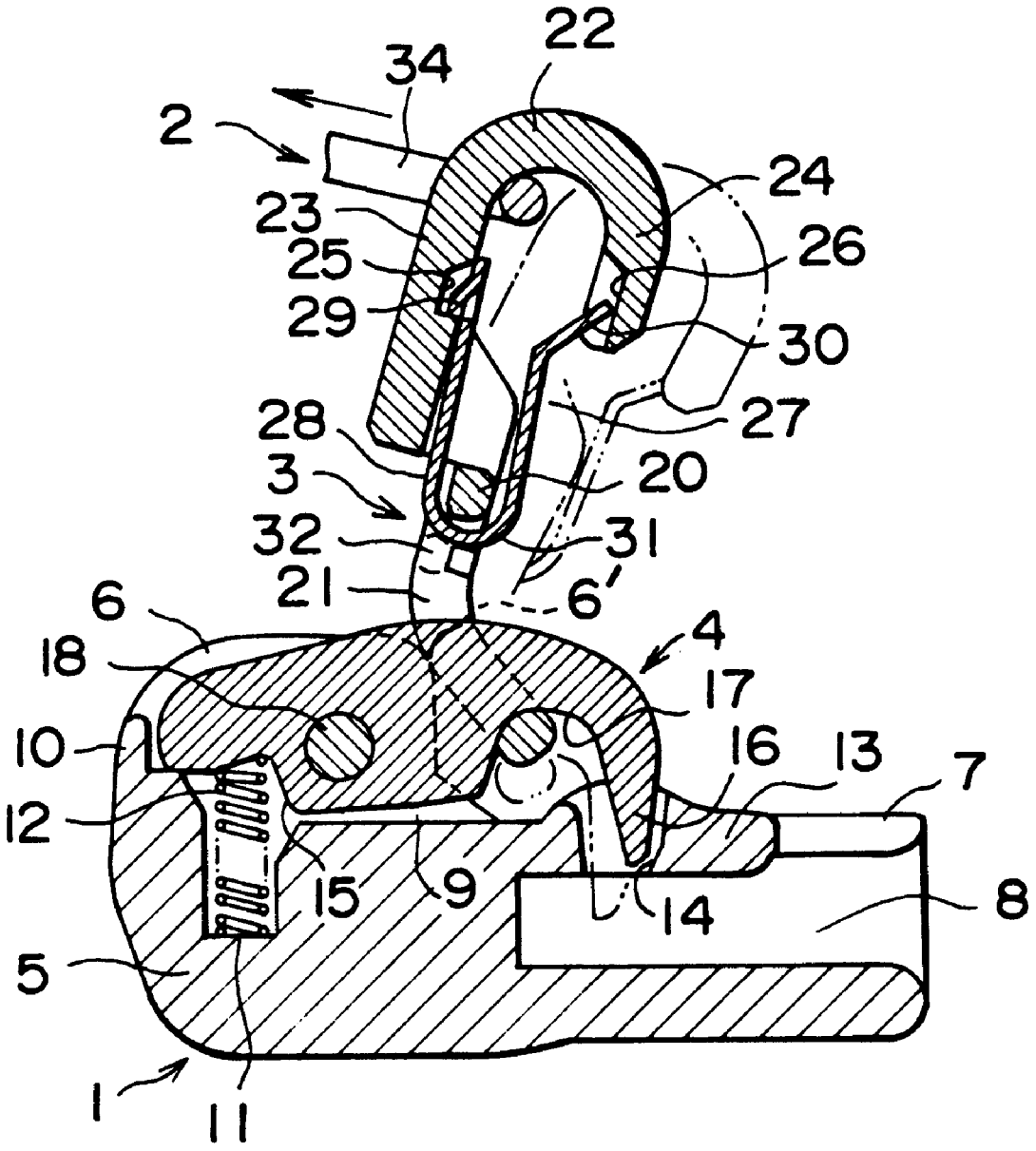
FIG. 2 is a longitudinal cross-sectional view of the slider of FIG. 1.

In this slider, as shown in FIG. 2, the longitudinal groove 9 formed in the attachment lug 6 is partly defined by a front wall 10 and communicates with a vertical hole 11 formed in the guide post 5. The vertical hole 11 receives therein a coil spring 12 which has an upper end in a resilient contact with a front end of the locking lever 4. The guide post 5 has a triangular projection 13 extending from a rear end of the upper surface of the guide post 5 so as to be in horizontal alignment with the side flanges 7, the triangular projection 13 having a locking-pawl-insertion hole 14. The locking lever 4 has a hook-like shape and has in the lower surface of its front end a recess 15 so that the coil spring 12 can be stably engaged with the locking lever 4 resiliently and on its rear end a locking pawl 16 to be inserted into the locking-pawl-insertion hole 14 so as to project into the element guide channel 8. The locking lever 4 further has in the base of the locking pawl 16 thereof a cutout 17 in which the front end of the clamp 3 is to be loosely engaged. The locking lever 4 received in the longitudinal groove 9 is pivotally attached at its central position to the attachment lug 6 by a pin 18.

The clamp 3 has a triangular aperture 19, the opposite side edges of which are bent into a generally inverted L shape to form a bent portion 21. The bent portion 21 has such a shape that the bent portion 21 can come into contact with a rear surface or a corner 6' of the attachment lug 6 when the clamp 3 threaded on the locking lever 4 is raised as shown in FIG. 2 so that the clamp 3 stably assumes a generally upright posture, thus positioning the fulcrum of the pull tab 2 at higher point.

Further, the clamp 3 has a pull-tab-attachment hook 22 integrally formed with a base end 20 of the aperture 19 so as to bulge from the surface of the base end 20. The hook 22 has in the inner surface of its upper portion 23 an upper recess 25 and in the inner surface of its lower portion 24 a lower recess 26. A U-shape resilient plate 28 is arranged astride of the base end 20 so as to cover an opening of the hook 22. The resilient plate 28 has at one end an engaging projection 29 to be engaged in the upper recess 25 and at the other end an outwardly bent end portion 30 to be resiliently engaged in the lower recess 26. Also the resilient plate 28 has a turnover portion 31 extending astride of the base end 20 of the aperture 19 and is firmly held at its opposite side edges by a pair of bulge portions 32, 32 formed on opposite inner edges of the clamp 3 by crushing.

Figure 3:
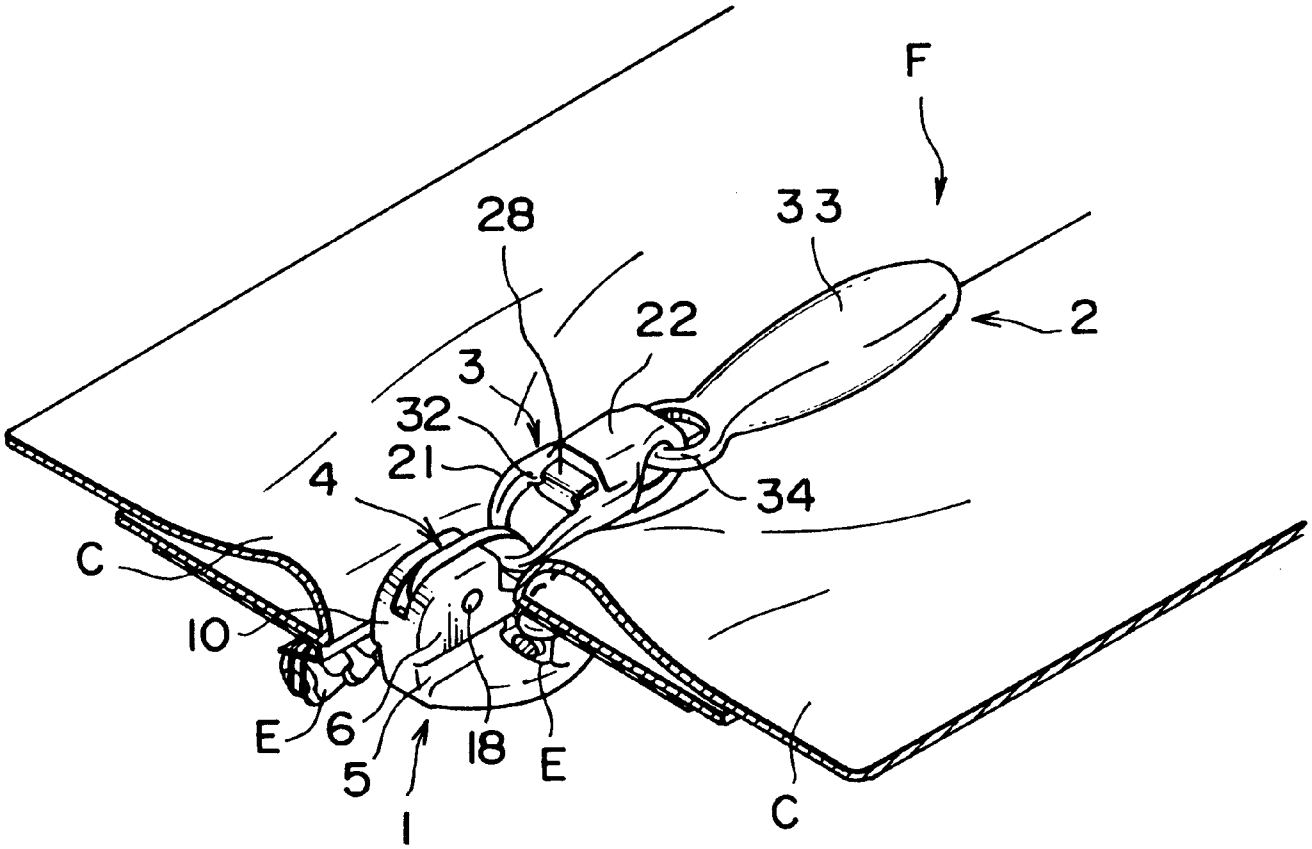
FIG. 3 is a perspective view, partly broken away, showing the slider being used on a garment.

As shown in FIG. 3, the pull tab 2 has a gripping portion 33 and an annular attaching portion 34 projecting from one end of the gripping portion 33 in a horizontal manner so as to be easily threaded on the clamp 3. For attaching the pull tab 2 to the clamp 3, the annular attaching portion 34 of the pull tab 2 is threaded on the hook 22 while pushing the bent end portion 30 of the resilient plate 28 inwardly against its resilience. For removing the pull tab 2 off the clamp 3, the bent end portion 30 is pressed inwardly against its resilience to open the hook 22 and then the attaching portion 34 is removed from the hook 22. With this type of clamp 3, the pull tab 2 can be exchanged with another.

For assembly, firstly the coil spring 12 is inserted in the vertical hole 11, which communicates with the longitudinal groove 9 of the attachment lug 6 of the slider body 1 and then the clamp 3 is loosely threaded on the locking lever 4. Then the locking pawl 16 of the locking lever 4 is inserted into the locking-pawl-insertion hole 14 while the locking lever 4 is inserted in the longitudinal groove 9 in such a manner that the front recess 15 resiliently touches the upper end of the coil spring 12, and the locking lever 4 is then pivotally mounted on the attachment lug 6 by the pin 18. This assembling is carried out by an automatic assembling machine.

Figure 4:
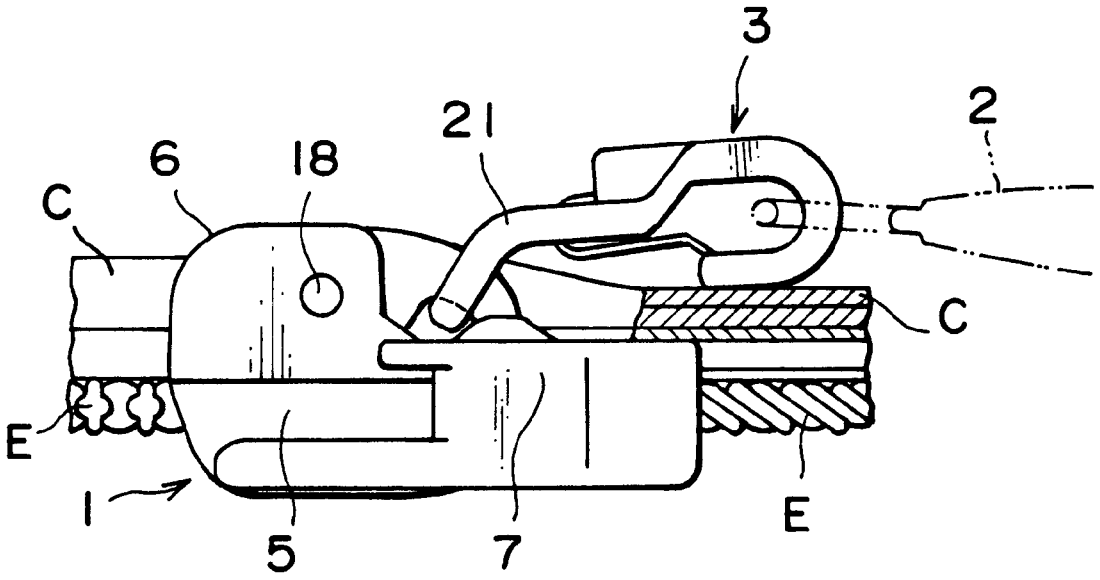
FIG. 4 is a side view, partly broken away, showing the slider being used.
Figure 5:
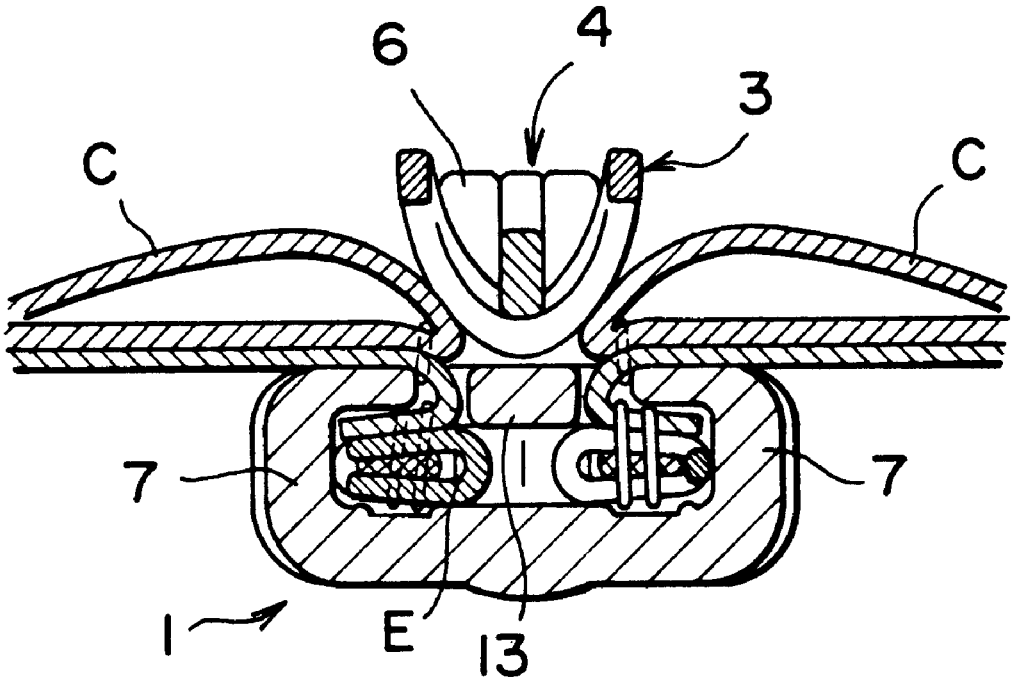
FIG. 5 is a transverse cross-sectional view showing the slider being used.

The operation of this auto-lock slider will now be described with reference to FIGS. 3 and 4. When the fastener chain F is partly closed, the pull tab 2 is in contact with the cloth C due to the bent portion 21 of the clamp 3. As shown in FIG. 5, the cloth C is jammed between the slider body 1 and the clamp 3 so that the clamp 3 is raised obliquely to the rear side, but the bent portion 21 makes the hook 22 of the clamp 3 come into contact with the cloth C, the pull tab 2 is kept stably in hanging posture.

For opening the fastener chain F, the pull tab 2 is pulled obliquely to the rear side. In order to close the opened fastener chain F, the pull tab 2 is pulled in the direction of an arrow in FIG. 2 to bring the bent portion 21 of the clamp 3 into contact with the inner surface or corners 6" of the attachment lug 6. With continued pulling of the pull tab 2, the locking lever 4 is raised against the resilience of the coil spring 12 according to the lever's principle and, at the same time, the locking pawl 16 is removed off the fastener elements E. At that time, the clamp 3 keeps the hook 22 in upright posture, without being inclined by so great angle and, therefore, the fulcrum point of the pull tab 2 is set in a high position, so that the slider can avoid any contact with the cloth C and be slid forwardly in a stabilized posture without difficulty to close the fastener chain F.

Figure 6:
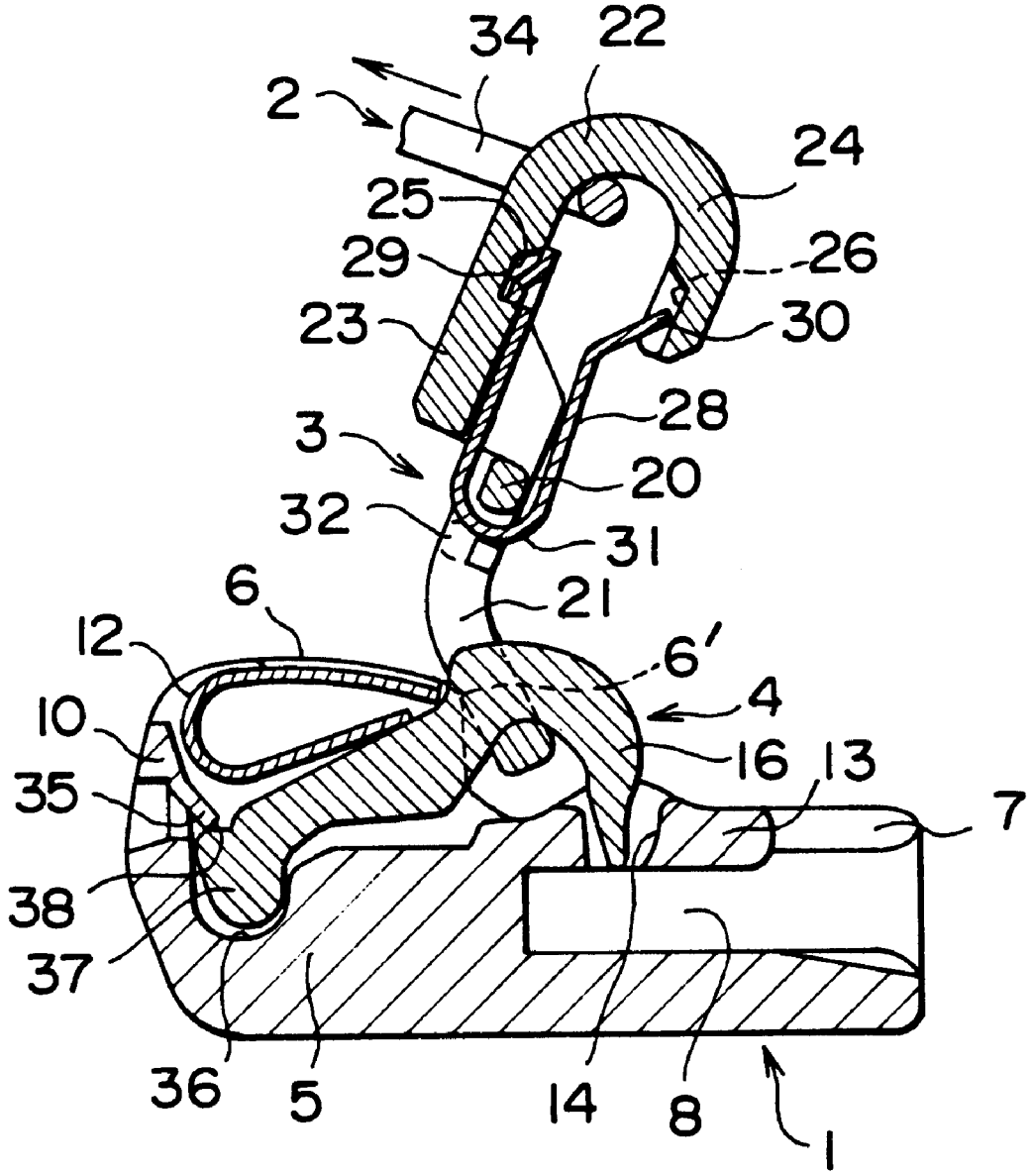
FIG. 6 is a longitudinal cross-sectional view of an auto-lock slider, for a concealed slide fastener, according to a second embodiment.

FIG. 6 shows an auto-lock slider, for a concealed slide fastener, according to a second embodiment. The second embodiment is differentiated from the first embodiment in: that the locking lever 4 and the coil spring 12, which are disposed in the attachment lug 6, are modified in shape as described below; that the longitudinal groove 9 has a bottom lower than the upper surface of the slider body 1; that a front wall 10 in front of the longitudinal groove 9 has a tongue 35 punched inwardly from its base; and that a U-shaped engaging recess 36 is formed in the bottom of the longitudinal groove 9. The locking lever 4 inserted in the longitudinal groove 9 has at its rear end a locking pawl 16 and at its front end a U-shaped engaging projection 37 to be received in the engaging recess 36. The engaging projection 37 has on its upper surface a stepped portion 38 against which the tongue 35 of the front wall 10 is to be disposed when the engaging projection 37 is received in the engaging recess 36. As a result, the locking lever 4 is pivotally mounted in the slier body 1. A U-shaped leaf spring 12 is mounted on the attachment lug 6 so as to be resiliently engaged with the upper surface of the locking lever 4 which is pivotally movable with respect to the slider body 1. The clamp 3 connected with the locking lever 4 is identical in structure with that of the first embodiment.

Figure 7:
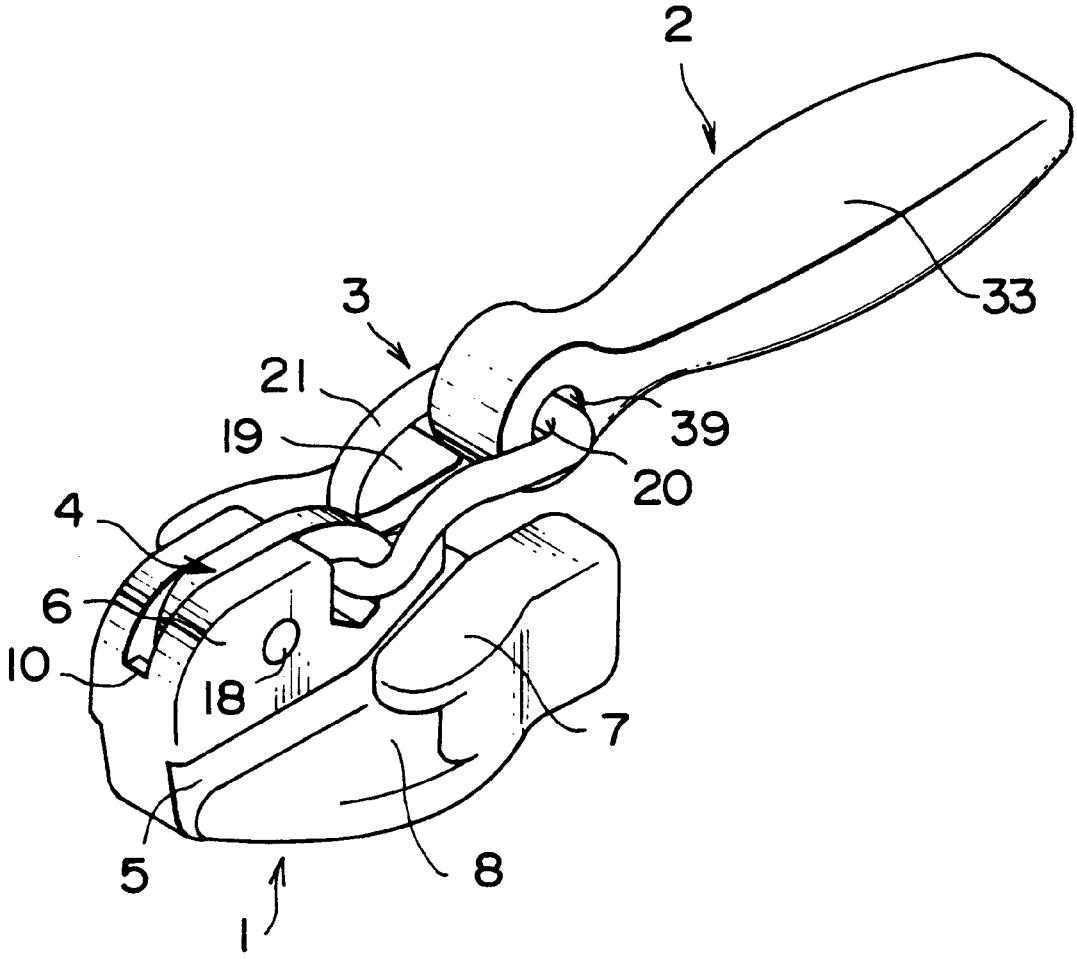
FIG. 7 is a perspective view of an auto-lock slider, for a concealed slide fastener, according to a third embodiment.

FIG. 7 shows an auto-lock slider, for a concealed slide fastener, according to a third embodiment. The third embodiment is identical with the first embodiment except that the clamp 3 is triangular in shape and has a varying width within the width of the attachment lug 6. The clamp 3 has a bent portion at its center portion. The pull tab 2 has a horizontal hole 39 through which the base end 20 of the clamp 3 is threaded. Thus the pull tab 2 is pivotally connected to the clamp 3.

Figure 8:
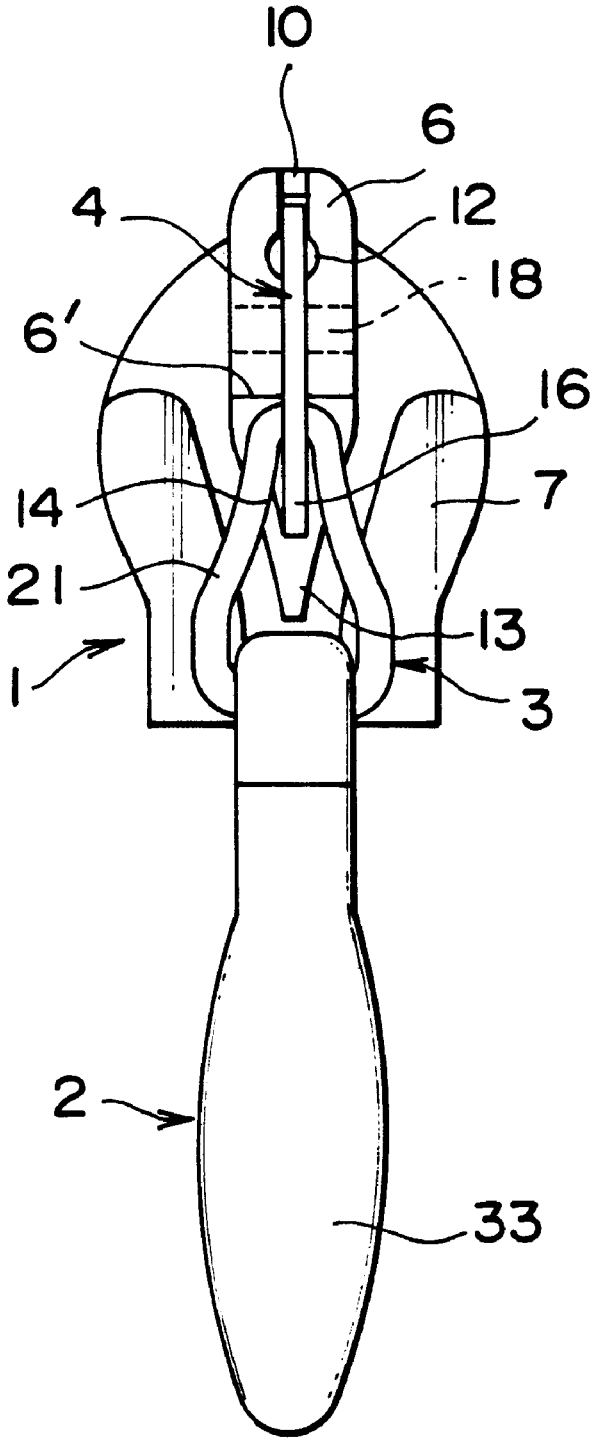
FIG. 8 is a plan view of an auto-lock slider, for a concealed slide fastener, according to a fourth embodiment.

FIG. 8 shows an auto-lock slider, for a concealed slide fastener, according to a fourth embodiment. The fourth embodiment is identical with the third embodiment except that the clamp 3 is slightly modified in shape. The front part of the clamp 3 has an inside width substantially equal to the thickness of the locking lever 4, so that the pivotal movement of the clamp 3 is directed in one way and may be used also in the first embodiment.

Figure 9:
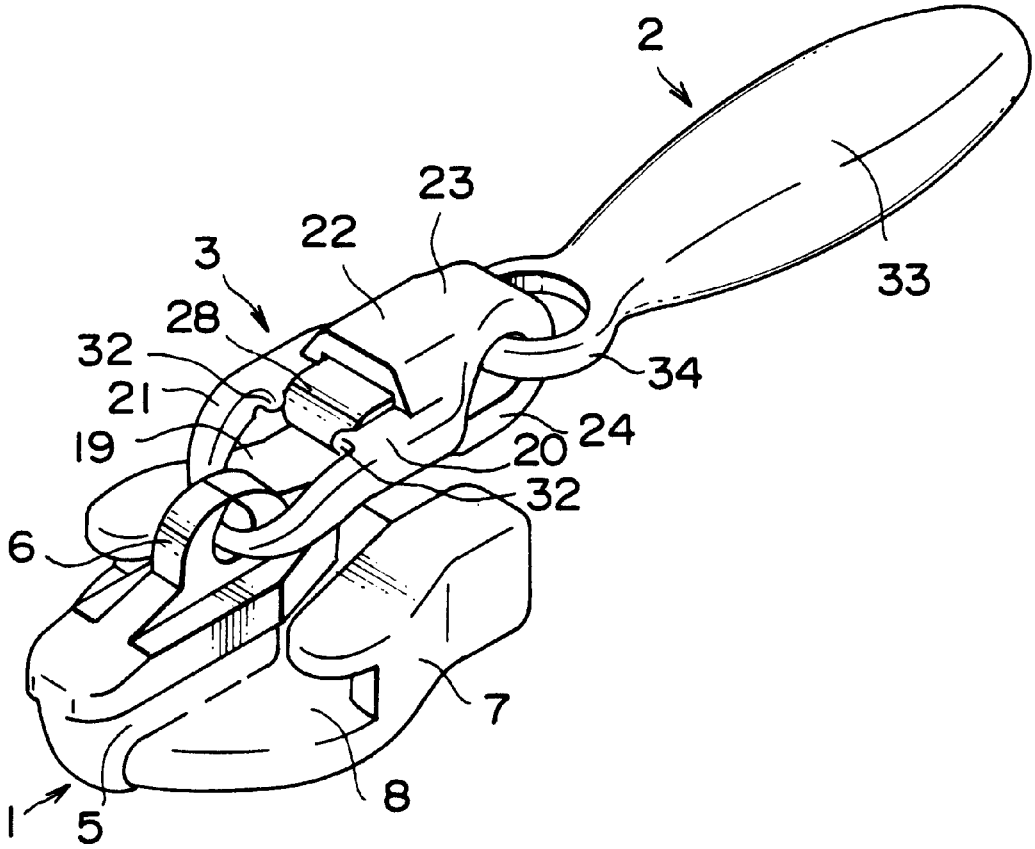
FIG. 9 is a perspective view of a free-type slider, for a concealed slide fastener, according to a fifth embodiment.
Figure 10:
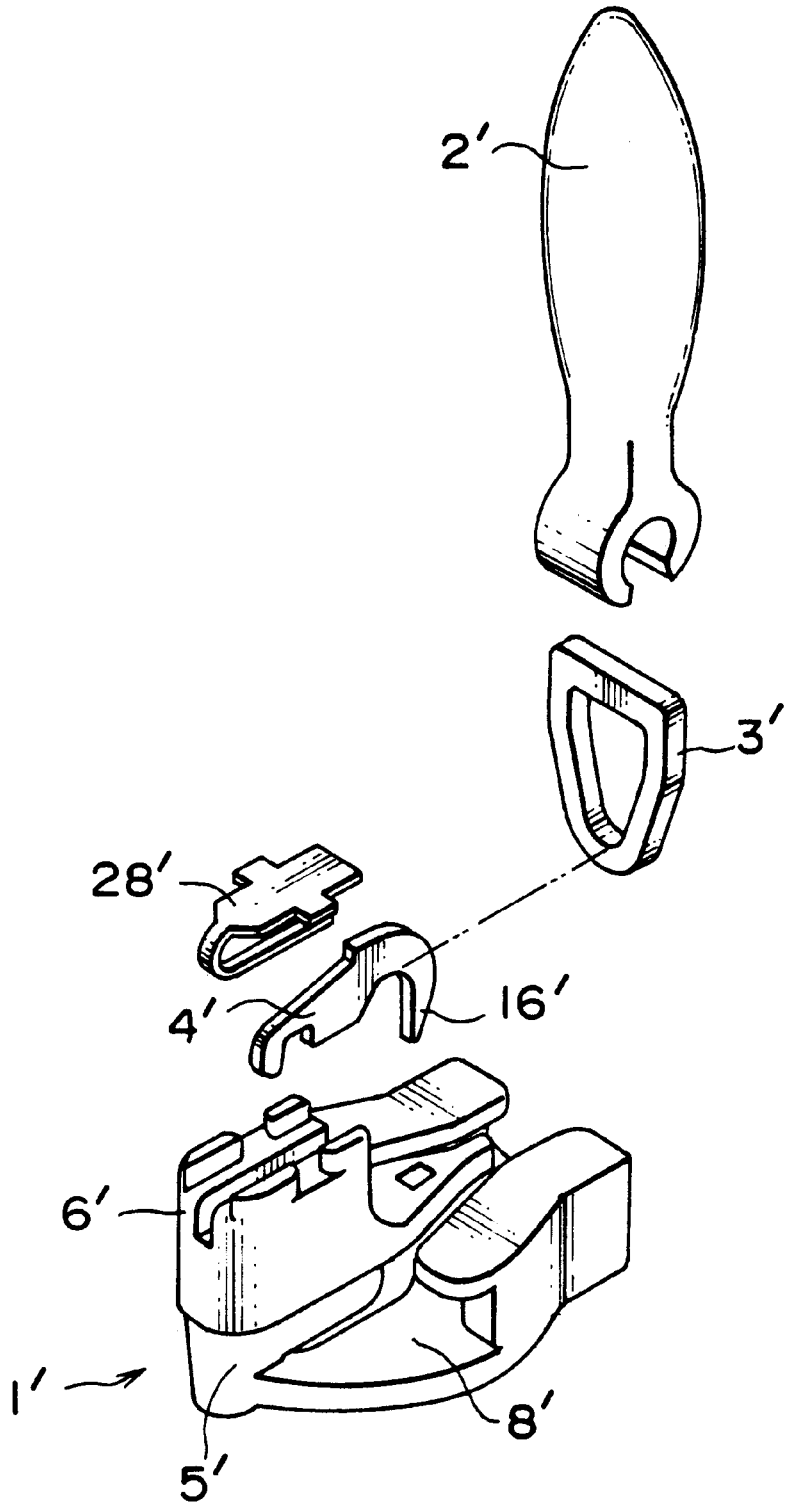
FIG. 10 PRIOR ART
FIG. 10 is an exploded perspective view of a conventional auto-lock slider for a concealed slide fastener.
Figure 11:
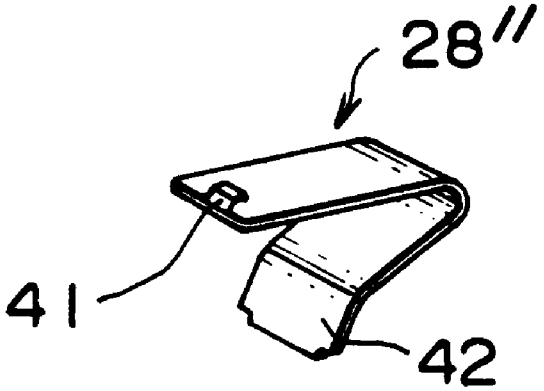
FIG. 11 PRIOR ART
FIG. 11 is a perspective view of a conventional auto-lock slider, including a clamp.
Figure 11:
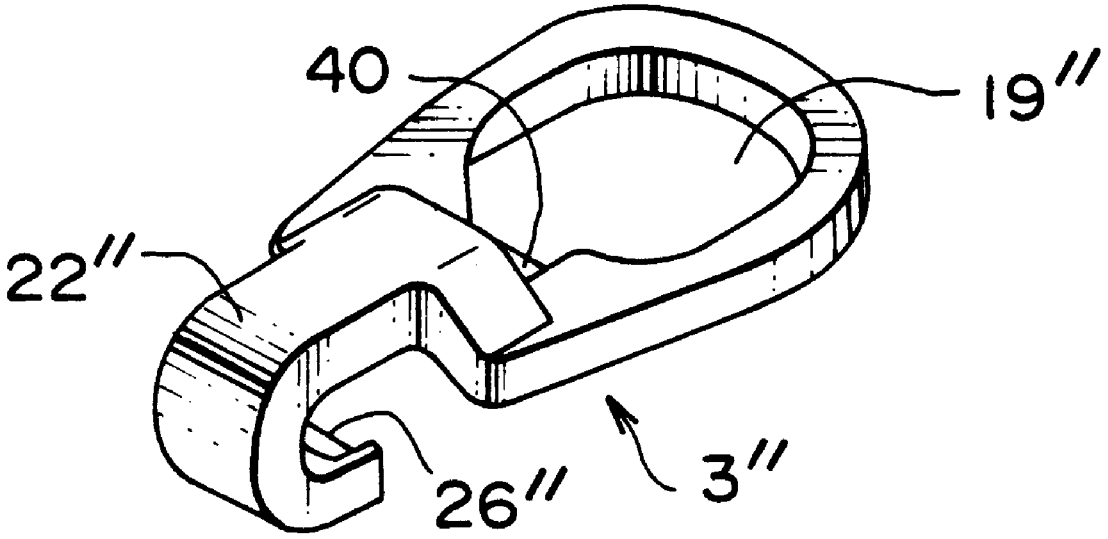
FIG. 11 PRIOR ART

FIG. 9 shows a free-type slider, for a concealed slide fastener, according to a fifth embodiment. In this embodiment, the pull tab 2 and the clamp 3 are totally identical in shape with those of the first embodiment of FIGS. 1 through 5.

The clamp 3 has a triangular aperture 19, the opposite side edges which are centrally bent into an inverted L shape to form a bent portion 21. Further, the clamp 3 has a pull-tab-attachment hook 22 integrally formed with a base end 20 of the aperture 19 so as to bulge from the surface of the base end 20. The hook 22 has in the inner surface of its base portion 23 an upper recess and in the inner surface of its lower portion 24 a lower recess. A U-shaped resilient plate 28 is positioned astride of the base end 20 so as to cover an opening of the hook 22. The resilient plate 28 has at one end an engaging projection to be engaged in the upper recess and at the other end an outwardly bent end portion to be resiliently engaged in the lower recess. Also the resilient plate 28 has a turnover portion extending astride of the base end 20 of the aperture 19 and is firmly held at its opposite side edges by a pair of bulge portions 32, 32 formed on opposite inner edges of the clamp 3 by crushing.

The pull tab 2 has a gripping portion 33 and an annular attaching portion 34 projecting from one end of the gripping portion 33 in a horizontal manner so as to be easily threaded on the clamp 3. For attaching the pull tab 2 to the clamp 3, the annular attaching portion 34 of the pull tab 2 is threaded on the hook 22 while pushing the bent end portion 30 of the resilient plate 28 inwardly against its resilience. For removing the pull tab 2 off the clamp 3, the bent end portion 30 is pressed inwardly against its resilience to open the hook 22 and then the attaching portion 34 is removed from the hook 22. With this type of clamp 3, the pull tab 2 can be exchanged with another.

The aperture 19 of the clamp 3 connected with the pull tab 2 is threaded on a U-shaped attachment lug 6 standing on the upper surface of the guide post 5 of the slider body 1, whereupon the attachment lug 6 is clenched. Thus the clamp 3 is pivotally attached to the attachment lug 6.

In the foregoing embodiments, it is preferable that the slider body 1 and the pull tab 2 are formed of metal by die-cast molding while the clamp 3 and the locking lever 4 are formed of a metal plate by pressing.

With the foregoing concealed slide fastener sliders, the following advantageous results can be achieved:

According to the first aspect of the invention, in the auto-lock slier or the free-type slider for a concealed slide fastener, the pull tab 2 is pivotally attached to the base end 20 of the clamp 3, which is attached to the attachment lug 6 via the aperture 19 of the clamp 3, and the clamp 3 has opposite side edges centrally bent into an inverted L shape to form a bent portion 21 so that the clamp 3 is mounted on the slider body 1 so as to fall to a rear side of the body 1. Thus, if a cloth such as of a garment is jammed between the slider body 1 and the clamp 3, the pull tab 2 rests on the cloth by the pressing action of the clamp 3 even when the clamp 3 is raised due to the jamming, thus keeping the pull tab 2 in contact with the cloth so that the fastener chain can be closed and opened smoothly and reliably. Further, as the pull tab 2 is stabilized in position all times, the slider is neat in appearance.

According to the second aspect of the invention, partly since the resilient locking lever 4 has at its rear end a locking pawl 16 and is attached at its front end to the attachment lug 6, and partly since the clamp 3 is loosely threaded on the locking lever 4 and is bent into an inverted L shape so as to fall down only to the rear side of the slider body 1, the fastener chain can be closed and opened smoothly and reliably so that the auto-lock slider is excellent in operability and neat in appearance.

According the third aspect of the invention, partly since the clamp 3 has a triangular aperture, from the base end 20 of which a pull-tab-attachment hook 22 integrally projects, and a U-shaped resilient plate 28 having a turnover portion 31 is placed astride of the base end 20 so as to cover an opening of the hook 22 in such a manner that both ends of the resilient plate 28 resiliently contact with the inner surface of the hook 22, and partly since the clamp 3 has in its inner surfaces a pair of bulge portions by which the turnover portion 31 of the resilient plate 28 is kept in position, the clamp 3 is directed in substantially only one way regardless of the direction of pulling of the pull tab 2, and the pull tab 2 can be exchanged with another. Further, since a resilient plate 28 is firmly mounted on the clamp 3, this slider is good in durability and can be smoothly operated.

According to the fourth aspect of the invention, since the attachment lug 6 has a pair of inner corners 6', 6' with which the bent portion 21 of the clamp 3 is touchable, the locking lever 4 can be raised simply and reliably by the lever action of the clamp 3 with the attachment lug 6 serving as a fulcrum when the clamp 3 stand upright, thus facilitating sliding the slider with the locking lever 4 kept in the raised position.

According to the fifth aspect of the invention, partly since the clamp 3 has the aperture in its center and has a varying width progressively increasing from its front end toward the base end 2 to which the pull tab 20 is attached, and partly since the bent portion 21 of the clamp 3 has a width within that of the attachment lug 6, the lever's principle can be applied using the clamp 3 simple in structure and easy to manufacture, thus achieving easy assembling of the slider and reducing the cost of production.

According to the sixth aspect of the invention, since the aperture 19 of the clamp 3 between the bent portion 21 and the front end of the clamp 3 has a width corresponding to that of the locking lever 4, the clamp 3 is directed reliably in one way so that various forms of the clamps 3 can be applied as the clamp 3 can pivotally move along the locking lever 4 in a simple manner, thus causing the slider to slide smoothly.

According to the seventh aspect of the invention, partly since the clamp 3 is directly attached to the attachment lug 6 via the base end 20 of the triangular aperture 19 of the clamp 3, a pull-tab-attachment hook 22 projects from the base end 20 astride of which a U-shaped resilient plate 28 is placed so as to cover the opening of the hook 22 in such a manner that opposite ends of the resilient plate 28 resiliently touch inner surfaces of the hook 22, and partly since the clamp 3 has in its inner surfaces a pair of bulge portions 32, 32 by which the turnover portion 31 of the resilient plate 28 is kept in position, the clamp 3 is directed in substantially only one way regardless of the direction of pulling of the pull tab 2, and the pull tab 2 can be exchanged with another. Further, since the resilient plate 28 is fixed by the clamp 3, the slider can be smoothly operated and is good in durability, which makes it possible to easily manufacture a free-type slider, which has a simple structure, for a concealed slide fastener.

What is claimed is:

1. A slider for a concealed slide fastener comprising:

(a) a slider body having a guide post at its front end and a pair of side guide flanges bent from its opposite side edges so as to define therebetween an element guide channel;

(b) an attachment lug standing on the guide post;

(c) a clamp directly or indirectly attached to the attachment lug and having a central bent portion bent into a generally inverted L shape so that the camp can fall to a rear side of the slider body, the clamp having an aperture and a base end with the central bent portion as a center disposed between the aperture and the base end; and (d) a pull tab pivotally attached to the base end of the clamp.

2. A concealed slide fastener slider according to claim 1, further comprising an auto-lock mechanism including a resilient locking lever loosely inserted through the aperture of the clamp, the locking lever being pivotally attached at one end to the attachment lug and having at the other end a locking pawl.

3. A concealed slide fastener slider according to claim 2, wherein the clamp has a pull-tab-attachment hook projecting from the base end, astride of which a U-shaped resilient plate having a turnover portion extends so as to cover an opening of the hook in such a manner that opposite ends of the resilient plate resiliently touch inner surfaces of the hook, the clamp having in its inner surfaces a pair of bulge portions by which the turnover portion of the resilient plate is kept in position, the aperture having a triangular shape.

4. A concealed slide fastener slider according to claim 2, wherein the attachment lug has a pair of inner corners with which the bent portion of the clamp is touchable so that the clamp can stand upright on the front side of the slider body.

5. A concealed slide fastener slider according to claim 4, wherein the clamp has the aperture in its center and has a varying width progressively increasing from its front end toward the base end to which the pull tab is pivotally attached, the bent portion of the clamp having a width within that of a width of the attachment lug.

6. A concealed slide fastener slider according to claim 4, wherein the aperture of the clamp extending from the bent portion to the front end of the clamp has a width corresponding to the width of the locking lever.

7. A concealed slide fastener slider of a free type according to claim 1, wherein the clamp has a pull-tab-attachment hook projecting from the base end, astride of which a U-shaped resilient plate having a turnover portion extends so as to cover an opening of the hook in such a manner that opposite ends of the resilient plate 28 resiliently touch inner surfaces of the hook, the clamp having in its inner surfaces a pair of bulge portions by which the turnover portion of the resilient plate is kept in position, the aperture having a triangular shape, the clamp being directly attached to the attachment lug.

* * * * *